US006952190B2

(12) United States Patent
Lynch et al.

(10) Patent No.: US 6,952,190 B2
(45) Date of Patent: Oct. 4, 2005

(54) LOW PROFILE SLOT ANTENNA USING BACKSIDE FED FREQUENCY SELECTIVE SURFACE

(75) Inventors: Jonathan J. Lynch, Oxnard, CA (US); Daniel F. Sievenpiper, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/663,975

(22) Filed: Sep. 16, 2003

(65) Prior Publication Data

US 2004/0075617 A1 Apr. 22, 2004

Related U.S. Application Data

(60) Provisional application No. 60/419,257, filed on Oct. 16, 2002.

(51) Int. Cl.[7] ..... H01Q 15/02
(52) U.S. Cl. ..... 343/909; 343/756; 343/700 MS
(58) Field of Search ..... 343/700 MS, 909, 343/910, 771, 756

(56) References Cited

U.S. PATENT DOCUMENTS

| | | | | |
|---|---|---|---|---|
| 5,576,718 A | 11/1996 | Buralli et al. | ..... | 343/700 MS |
| 5,942,950 A | 8/1999 | Merenda | ..... | 331/99 |
| 6,008,762 A | 12/1999 | Nghiem | ..... | 343/700 MS |
| 6,023,209 A | 2/2000 | Faulkner et al. | ..... | 333/238 |
| 6,175,337 B1 | 1/2001 | Jasper, Jr. et al. | ..... | 343/770 |
| 6,262,495 B1 | 7/2001 | Yablonovitch et al. | ..... | 307/101 |
| 6,426,722 B1 | 7/2002 | Sievenpiper et al. | ..... | 343/700 |

FOREIGN PATENT DOCUMENTS

| | | |
|---|---|---|
| WO | 99/50929 | 10/1999 |
| WO | 01/95434 A1 | 12/2001 |
| WO | 02-103846 A1 | 12/2002 |

OTHER PUBLICATIONS

Sievenpiper, D., et al., "High–Impedance Elecromagnetic Surfaces with a Forbidden Frequency Band," *IEEE Transactions on Microwave Theory and Techniques*, vol. 47, No. 11, pp. 2059–2074 (Nov. 1999).

Ying, Z., et al., "Improvements of Dipole, Helix, Spiral, Microstrip, Patch and Aperature Antennas with Ground Planes By Using Corrugated Soft Surfaces, " *IEEE Proceedings: Microwaves, Antennas, and Propagation*, vol. 143, No. 3, pp. 244–248 (Jun. 1996).

*Primary Examiner*—Hoang V. Nguyen
(74) *Attorney, Agent, or Firm*—Ladas & Parry

(57) ABSTRACT

A low profile, wide band gap antenna having a high impedance surface, the high impedance surface including a conductive plane and an array of conductive elements spaced from the conductive plane by a distance which is no greater than 10% of a wavelength of an operating frequency of the antenna structure. The conductive plane has an opening therein which is driven by an antenna driving element adjacent the opening in the conductive plane.

46 Claims, 4 Drawing Sheets

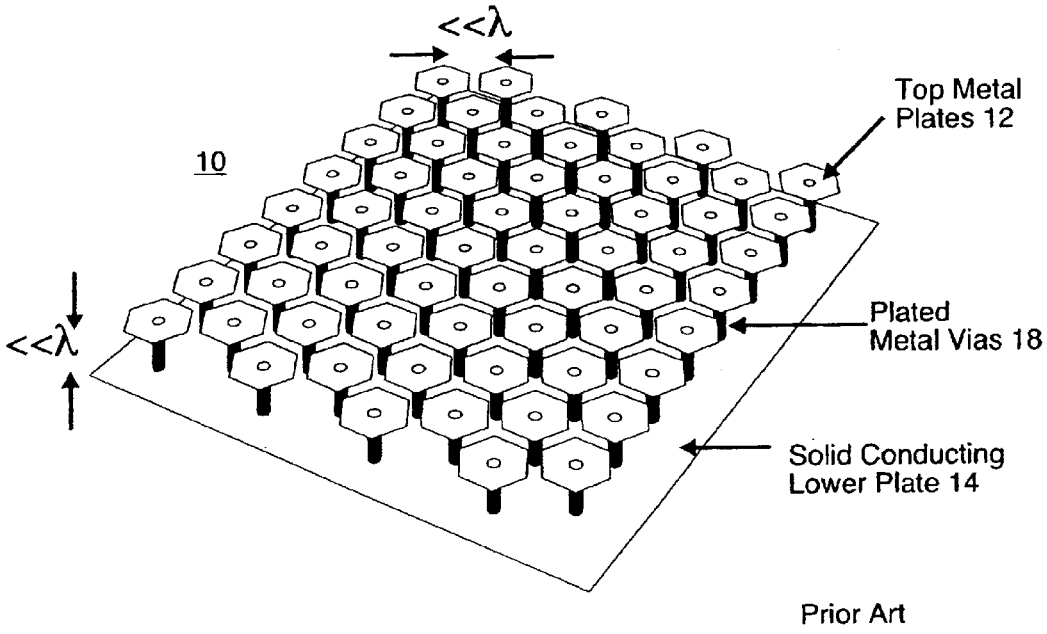
Figure 1a
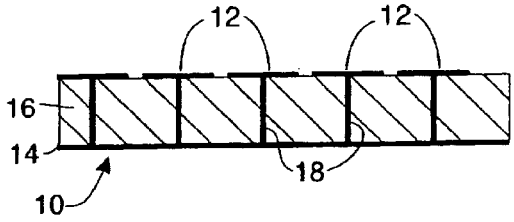
Prior Art Figure 1b
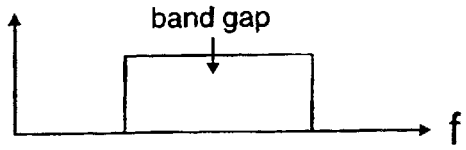
Prior Art Figure 1c

LOW PROFILE SLOT ANTENNA USING BACKSIDE FED FREQUENCY SELECTIVE SURFACE

CROSS REFERENCE TO RELATED APPLICATIONS

This application claims the benefit of U.S. Provisional Patent Application No. 60/419,257 filed Oct. 16, 2002, entitled "Low Profile Slot Antenna Using Backside Fed Frequency Selective Surface", the disclosure of which is incorporated herein by reference.

TECHNICAL FIELD

The present invention relates to a slot antenna which may be flush-mounted and provides a good impedance match to a transmitter and/or a receiver that is coupled to the antenna.

BACKGROUND OF THE INVENTION

The prior art includes an application of D. Sievenpiper, E. Yablonovitch, "Circuit and Method for Eliminating Surface Currents on Metals" U.S. provisional patent application, Ser. No. 60/079,953, filed on Mar. 30, 1998 which relates to a high-impedance or Hi-Z surface and its corresponding PCT application PCT/US99/06884, published as WO99/50929 on Oct. 7, 1999 which application discloses a high impedance surface (also called a Hi-Z or a Frequency Selective Surface herein).

The Hi-Z surface, which is the subject matter of U.S. patent application Ser. No. 60/079,953, is depicted in FIG. 1*a*. This surface 10, which may also be referred to as a Frequency Selective Surface (FSS), includes an array of metal elements 12 arranged above a flat metal ground plane 14. The size of each element 12 is much less than the operating wavelength of the antenna. The overall thickness of the structure is also much less than the operating wavelength. The presence of the elements 12 has the effect of changing the boundary condition at the surface, so that it appears as an artificial magnetic conductor, rather than an electric conductor. It has this property over a band gap ranging from a few percent to nearly an octave, depending on the thickness of the structure with respect to the operating wavelength (see FIG. 1*c*). A Hi-Z surface 10 can be made in various forms, including a multi-layer structure with overlapping capacitor plates. Preferably the Hi-Z structure is formed on a printed circuit board insulating substrate 16 (omitted in FIG. 1*a* for clarity purposes) with the elements 12 formed on one major surface thereof and the ground plane 14 formed on the other major surface thereof. Elements 12 are preferably electrically coupled to the ground plane 14 by means of conductive vias 18, which vias 18 may be formed by plating through holes formed in the printed circuit board 16. Capacitive loading allows the resonance frequency to be lowered for a given thickness. Operating frequencies ranging from hundreds of megahertz to tens of gigahertz have been demonstrated using a variety of geometries of Hi-Z surfaces. The shapes of elements 12, in plan view, can be square, hexagonal (as shown by FIG. 1*a*) or any other convenient, repeating geometric shape.

A prior art waveguide fed, aperture-coupled slot or patch antenna is depicted in a side elevational view by FIG. 1*d*. The patch antenna element 8 is disposed over a back plane 14 which has an opening or slot 9 therein which is directly coupled to the walls of a waveguide 22. These antennas are flat, but they also tend to have high Qs. That is, an acceptable impedance match between the waveguide 22 and the antenna 8 can only be achieved over a rather narrow bandwidth without the use of wideband impedance matching networks. FIG. 1*e* is a chart showing the simulated results for an antenna of the type shown in FIG. 1*d* over the frequency range of 11–16 Ghz (plot "A"). The high Q nature of this antenna is plainly evident. Patch antennas are also rather large (they have a physical size of about ½λ for the frequencies of interest), which often makes it difficult to arrange an array of such antennas in a confined space.

There are other techniques well known in the prior art for coupling a waveguide to an antenna structure. However, these prior art structure are not flat. Rather, they have profiles which project in a direction away from the waveguide (in the direction of arrow A in FIG. 1*d*). Thus, they have profiles, in side elevation view which makes them difficult for use on surfaces which should be either flat or moderated contoured, such a the surface of an aircraft or a land vehicle. In the automotive market, antennas which project from the surface of the vehicle are considered to be rather unsightly. So antennas which are flat (or which can be contoured if need be) are needed. Additionally, there is a need for a technique for coupling a waveguide to an antenna structure which is flat (and preferably which can be contoured when needed) with an acceptable impedance match over a relatively wide frequency band.

BRIEF DESCRIPTION OF THE INVENTION

In one aspect, the present invention provides an antenna structure having a high impedance surface, which comprises a conductive plane and an array of conductive elements spaced from the conductive plane by a distance which is less than 25% of a wavelength of an operating frequency of the antenna structure (and preferably no greater than 10% of a wavelength of an operating frequency of the antenna structure). The conductive plane has an opening therein that is driven an antenna driving element disposed adjacent the opening in the conductive plane. The driving element, in operation, excites the antenna structure by pumping RF energy through the opening in the conductive plane.

In another aspect, the present invention provides a method of making a low profile, wide band antenna comprising the steps of providing a high impedance surface, the high impedance surface having a conductive plane and an array of conductive elements spaced from the conductive plane by a distance which is no greater than 25% of a wavelength of an operating frequency of the antenna structure (and preferably no greater than 10% of a wavelength of an operating frequency of the antenna structure), the conductive plane having an opening therein; and disposing an antenna driving element adjacent the opening in the conductive plane.

BRIEF DESCRIPTION OF THE DRAWINGS

FIG. 1*a* is a perspective view of a Hi-Z surface;

FIG. 1*b* is a side elevation view of a Hi-Z surface;

FIG. 1*c* is an graph of the band gap of a Hi-Z surface;

DETAILED DESCRIPTION OF AN PREFERRED EMBODIMENT OF THE INVENTION

Figure 1D:
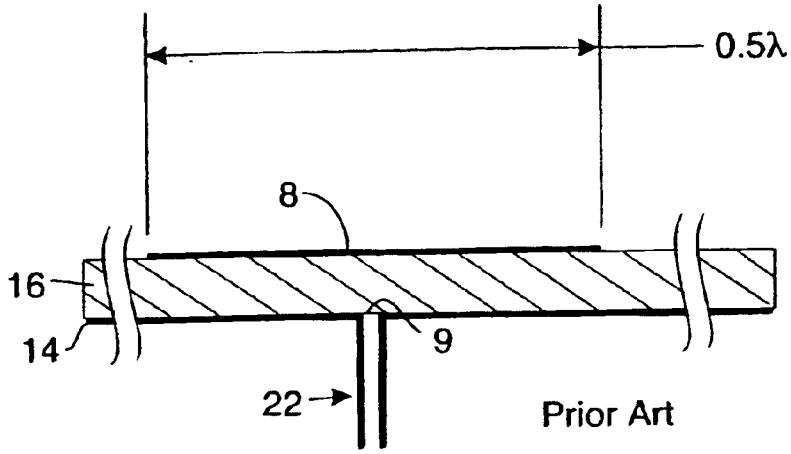
FIG. 1*d* is a side elevation view of a waveguide fed, aperture-coupled patch antenna.
Figure 1E:
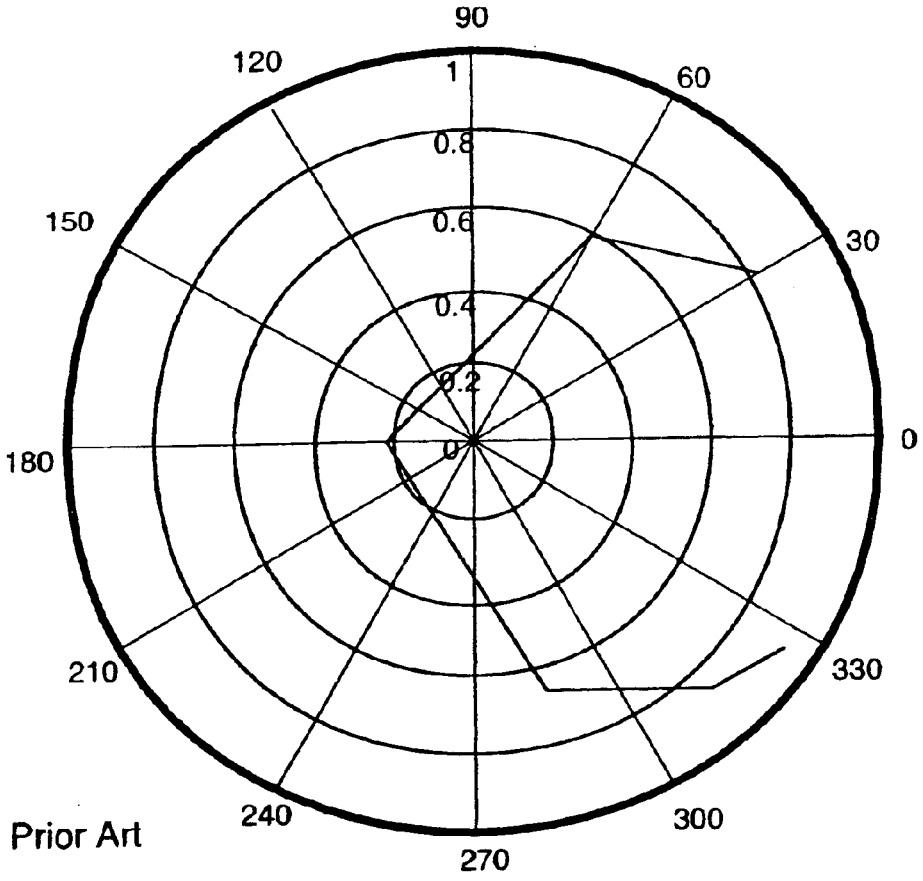
FIG. 1*e* is a Polar plot showing simulated results for $S_{11}$ of the antenna of FIG. 1*d;*

A Hi-Z or Frequency Selective Surface (FSS) 10 is fed via an aperture 20 in its backside or rear surface ground plane 14. The aperture 20 is preferably fed utilizing a waveguide 22 or a microstrip 24. The elements 12 on the front surface of the Hi-Z surface 10 and the ground plane 14 on its rear surface are electrically conductive and preferably made of a metal such as copper. Indeed, the Hi-Z or frequency Selective Surface 10 is preferably made from a plated printed circuit board 16 as previously mentioned.

Figure 2B:
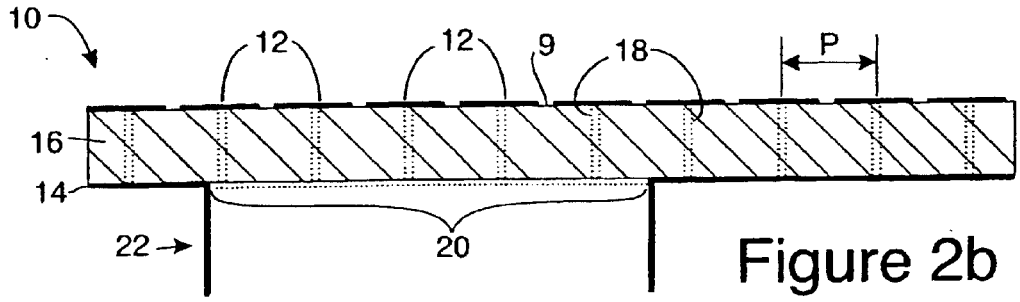
FIG. 2*b* depicts a side elevation view of the Frequency Selective or Hi-Z Surface of FIG. 2*a*, the section being taken along line 2*b*—2*b* in FIG. 2*a;*
Figure 2A:
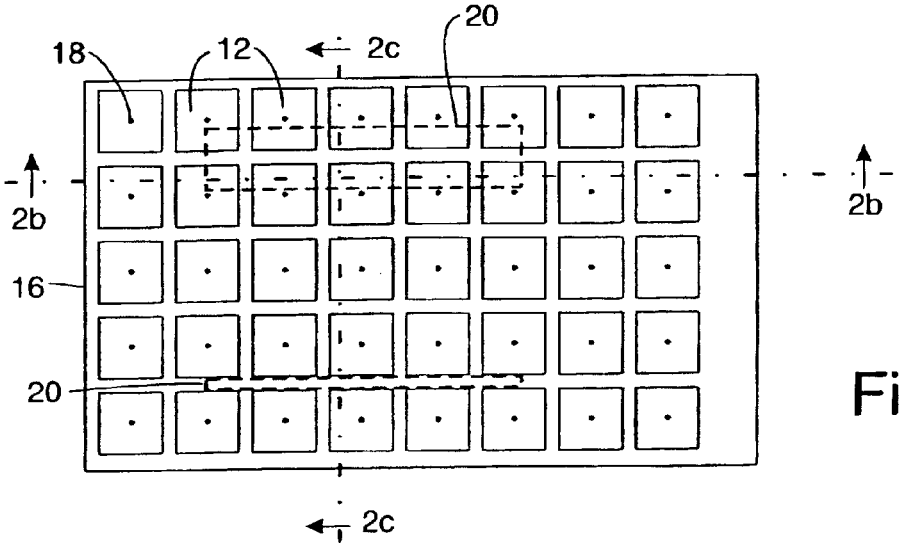
FIG. 2*a* is a plan view of the Frequency Selective or Hi-Z Surface having an aperture in its ground plane.
Figure 2C:
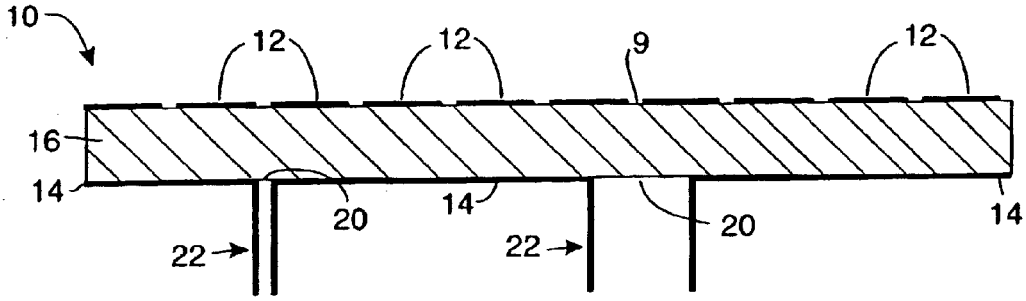
FIG. 2*c* depicts a side elevation view of the Frequency Selective or Hi-Z Surface of FIG. 2*a*, the section being taken along line 2*c*—2*c* in FIG. 2*a;*

One embodiment of a slot antenna using waveguide, backside fed frequency selective surface is depicted by FIGS. 2*a*–2*c*. FIG. 2*a* is a plan view thereof while FIG. 2*b* is a cross sectional view taken at section line 2*b*—2*b* depicted in FIG. 2*a* and FIGS. 2*c* is a cross sectional view taken at section line 2*b*—2*b* depicted in FIG. 2*a*. The Hi-S surface of FIGS. 2*a*–2*c* is, in most respects, a convention Hi-Z of the type discussed with reference to FIGS. 1*a*–1*c*. There are two important differences, however.

First, although not shown in FIGS. 1*a* or 1*b*, in order for the prior art Hi-Z surface to function as part of an antenna, one or more antenna elements must be placed thereon. In the embodiments disclosed herein, no such antenna elements are needed; indeed, it is believed that the addition of antenna elements on the modified Hi-Z surface of FIGS. 2*a*–2*c* would render the resulting antenna less functional (it would likely have a higher Q).

Second, the rear or ground plane 14 has an opening 20 therein which mates, in this embodiment, with a waveguide 22. In FIGS. 2*a* and 2*c*, two openings 20 and two corresponding waveguides 22 are shown for illustrative purposes. The ground plane may have a single opening 20 therein for, in this embodiment, one waveguide 22 or it may have multiple openings 20 therein for, in this embodiment, multiple waveguides 22. In any case the waveguides 22 are aligned with the opening 20 and preferably the aperture of the waveguide 22 matches the size of the corresponding opening 20. In another embodiment, which is subsequently described with reference to FIG. 2*e*, the opening 20 in rear or ground plane is driven by a microstrip line 24 instead of a waveguide 22.

The apertures of the waveguides 22 each define a rectangle. The longer side thereof is preferably about 0.5 λ to 1 λ at the frequency of interest. The shorter side of the rectangle is smaller and preferably ranges from (i) a width which is about equal to the spacing between elements 12 (see the waveguide on the left hand side of FIG. 2*c*) to (ii) a spacing which is about equal to the pitch of elements 12 (see the waveguide on the right hand side of FIG. 2*c*). The centers of elements 12 have pitch P which is less than 0.25 λ at the frequency of interest and more preferably have a pitch in the range of about ⅛ to 1/10 λ at the frequency of interest. The distance or gap 9 between the adjacent edges of elements 12 is much smaller, typically about 0.01 λ at the frequency of interest.

The sides of a waveguide 22 can mate exactly with the side of its corresponding opening 20 or the opening can be, in some embodiments, smaller that the size of the waveguide 22.

Figure 2D:
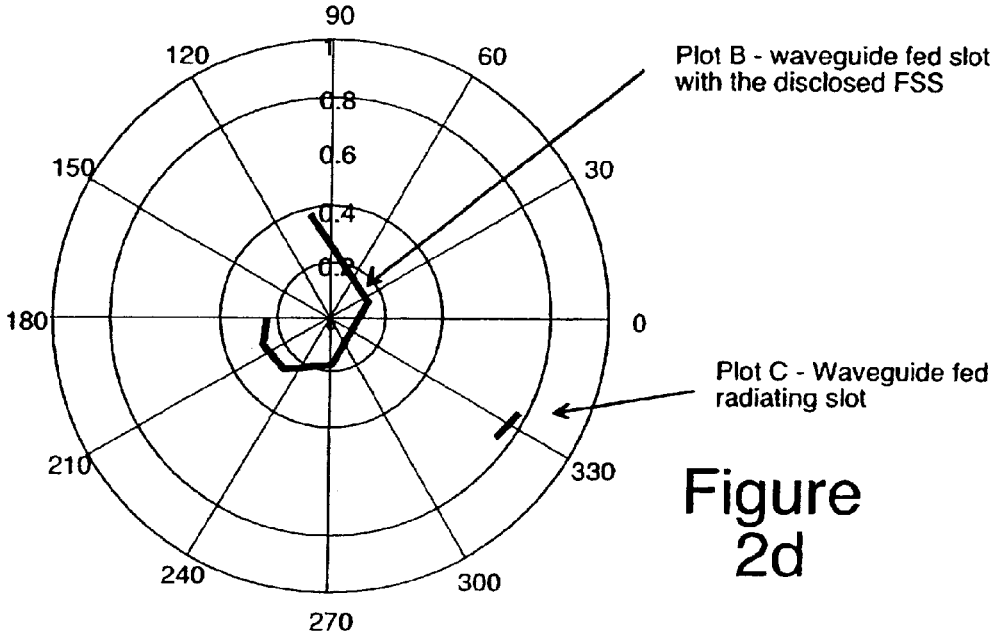
FIG. 2*d* is a Polar plot showing simulated results for $S_{11}$ of the antenna of FIG. 2*c;*

FIG. 2*d* is a polar plot of the input reflection coefficient of the waveguide of FIGS. 2*a*–2*c* based on a computer simulation (see plot "B"). The plot covers the frequencies of 11–16 GHz. For the simulation, the following structure parameters were used: element 12 size=124 mils square (3.15 mm on a side), element 12 pattern spacing (pitch)=125 mils (3.175 mm), gap 9 width=1 mil (0.025 mm), via 18 diameter=4 mils (0.1 mm), substrate thickness=20 mils (0.5 mm), substrate dielectric constant=3, waveguide (slot) width=40 mils. Plot "C" of FIG. 2*d* shows the effect of eliminating the Hi-Z surface 10. The effect is dramatic.

As can be seen from FIG. 2*d*, this embodiment of the antenna is an effective radiator of RF energy over a very wide frequency band of 11–16 GHz. Given a useable band width or gap of 5 GHz and an operating frequency as high as 16 GHz, this antenna design has a bandwidth which is over 30% the operating frequency! The antenna is also of an extremely low profile. The thickness of the insulating substrate 16 is only about 0.5 mm—even with the metal surfaces. The thickness of the Hi-Z surface should be less than 1 mm while a wavelength at 16 GHz is about 19 mm. The thickness of the antenna can be easily kept in the range of 5 to 10% of a wavelength of the frequencies of interest—certainly the thickness of the antenna can easily be kept less than 25% of a wavelength of the frequencies of interest (11–16 GHz for the antenna just described). Thus, the disclosed antenna can have an extremely low profile. It can easily be attached to or at the exterior surfaces of aircraft and land vehicles, for example, without being either unsightly or interfering with the operation of the aircraft/vehicle. If the antenna extends inwardly from an exterior surface of the aircraft/vehicle, it does not occupy much, if any, internal space of the aircraft/vehicle, given the thinness of the disclosed antenna.

Figure 2E:
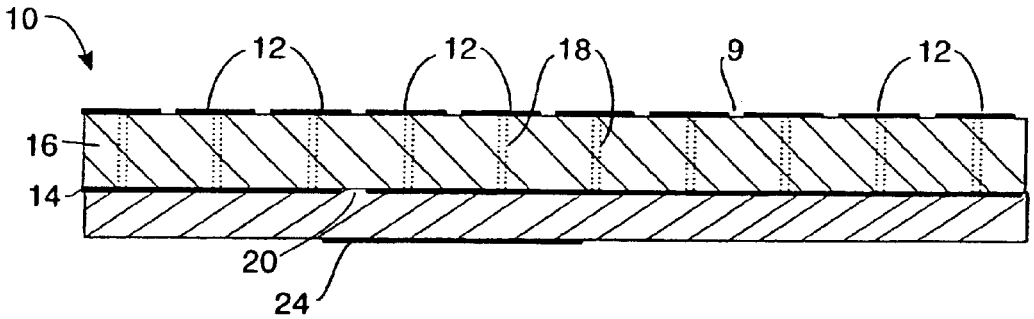
FIG. 2*e* is a plan view of another embodiment of the Frequency Selective or Hi-Z Surface having an aperture in its ground plane, this embodiment being driven by a microstrip adjacent the rear conductive surface of the Frequency Selective or Hi-Z Surface.

FIG. 2*e* depicts another embodiment of the present invention. In this embodiment, instead of using a waveguide 22 to drive the slot 20, a microstrip 24 is used instead. The microstrip is separated from the rear or ground plane 14 by a second insulating substrate 28. Otherwise, this embodiment is the same as the embodiment previously described. Of course, since this antenna has two substrates 14 and 28, it will be somewhat thicker than the embodiment just described. If the thickness of the second insulator is also 0.5 mm, the overall thickness of the Hi-Z surface and microstrip antenna, in the case of an antenna operating over a band gap of 11–16 GHz should be no thicker than 2 mm (which is only about 10% of λ at 16 Ghz).

The size of the opening 20 in the back plane 14 is essentially of the same size for either the waveguide fed embodiment of FIG. 2*c* or the microstrip line fed embodiment of FIG. 2*e* for a given range of frequencies of interest.

For the computer modeling of the waveguide fed embodiment of FIG. 2*c* and the microstrip line fed embodiment of FIG. 2*e*, it was assumed that the Hi-Z or Frequency Selective Surface (FSS) 10 extends for an infinite distance away from opening 20. It is believed that if the Hi-Z or Frequency Selective Surface (FSS) 10 extends a distance approximately equal to at least 10 λ for the frequencies of interest, the such a Hi-Z or Frequency Selective Surface (FSS) 10 will act essentially identically to the computer models based on an infinitely large surface. However, as the size of the Hi-Z or Frequency Selective Surface (FSS) decreases relative to the λ of the frequencies of interest, that edge effects will start to impact the antenna and that the results obtained will be less satisfactory that in the case of a larger Hi-Z or Frequency Selective Surface (FSS) 10. Thus, the Hi-Z or Frequency Selective Surface (FSS) 10 should extend at least a couple of wavelengths of the frequencies of interest away from opening 20 and more preferable should extend upwards of ten or greater wavelengths of the frequencies of interest away from opening 20.

This invention achieves a low profile antenna while having excellent bandwidth characteristics. Additionally, the construction of this antenna may be achieved by using only standard printed circuit techniques and therefore the disclosed antenna can be manufactured at an extremely low cost. The hi-Z surface disclosed herein can be easily manufactured using printed circuit board technology to form a rectangular or square metal grid of elements 12 printed on a suitable dielectric material 16 whose bottom side has a conductive back plane 14, with plated through holes 18 (vias) that connect each element 12 to the conductive back plane 14.

The waveguide embodiment and the microstrip embodiment each provide an antenna drive that excites the antenna through the opening 20 in the back conductive plane 20. In this way, the invention feeds the surface from the back plane 14 side of the Hi-Z surface 10 through an aperture or opening 20 in the conductive plane 14, thereby separating the feed circuitry for the antenna from the radiating elements on the front surface of the Hi-Z surface 10. The antenna has low profile, it is of low cost to manufacture and can be fabricated with all of the feed electronics shielded from the radiation zone by the conductive plane 14. The microstrip antenna drive can also be easily manufactured using standard printed circuit board manufacturing techniques.

The electrical properties of the Hi-Z surface 10 provide an impedance transformation from the (usually 50 Ω) low circuit or waveguide impedance to high free space impedance. By proper choice of the dimensions of the Hi-Z surface 10, an excellent impedance match can be achieved between the antenna feed and free space.

Having described this invention in connection with a preferred embodiment, modification will now certainly suggest itself to those skilled in the art. As such, the invention is not to be limited to the disclosed embodiments except as required by the appended claims.

What is claimed is:

1. An antenna structure comprising:

(a) a high impedance surface, the high impedance surface having a conductive plane and an array of conductive elements spaced from the conductive plane by a distance which is no greater than 25% of a wavelength of an operating frequency of the antenna structure, the conductive plane having an opening therein; and (b) an antenna driving element disposed adjacent the opening in the conductive plane on a side of the conductive plane which is remote from said array of conductive elements, which driving element, in operation, excites the antenna structure by pumping RF energy through the opening in the conductive plane.

2. The antenna structure of claim 1 wherein the conductive plane and the array of conductive elements are disposed on opposite side of a insulating substrate.

3. The antenna structure of claim 2 wherein each of the elements in the array is coupled to the conductive plane by a conductive via arranged through the insulating substrate.

4. The antenna structure of claim 3 wherein each conductive element in the array of conductive elements is of a polygonal configuration and wherein the conductive elements in the array are arranged in a regular repeating pattern of polygonal configurations.

5. The antenna structure of claim 4 wherein the polygonal configuration of each conductive element is a rectangle.

6. The antenna structure of claim 5 wherein the polygonal configuration of each conductive element is a square and wherein the square conductive elements are arranged with a common pitch in said array.

7. The antenna structure of claim 1 wherein the array of conductive elements is spaced from the conductive plane by a distance which is no greater than 10% of a wavelength of an operating frequency of the antenna structure.

8. An antenna structure comprising:

(a) a high impedance surface, the high impedance surface having a conductive plane and an array of conductive elements spaced from the conductive plane by a distance which is no greater than 25% of a wavelength of an operating frequency of the antenna structure, the array of conductive elements being arranged with a common pitch in said array, the conductive plane having an opening therein; and (b) an antenna driving element disposed adjacent the opening in the conductive plane, which driving element, in operation, excites the antenna structure by pumping RF energy through the opening in the conductive plane;

wherein the opening in the conductive plane is rectangular, having a breadth which is about 0.5 of a wavelength to one wavelength of the operating frequency of the antenna structure and a width which is no greater than the common pitch of the conductive elements in the array.

9. The antenna structure claim 8 wherein the width of the opening in the conductive plane is approximately equal to a spacing between adjacent ones of the conductive elements in said array.

10. The antenna structure of claim 8 wherein the antenna driving element is a waveguide.

11. The antenna structure of claim 10 wherein the waveguide has walls adjacent its aperture, which walls have a rectangular configuration adapted to mate with the opening in the conductive plane.

12. The antenna structure of claim 8 wherein the antenna driving element is a microstrip radiator disposed opposite the opening in the conductive plane, spaced from the opening in the conductive plane by a distance which is less than 10% of a wavelength of the operating frequency of the antenna structure.

13. A method of making an antenna comprising:

(a) providing a high impedance surface, the high impedance surface having a conductive plane and an array of conductive elements spaced from the conductive plane by a distance which is no greater than 25% of a wavelength of an operating frequency of the antenna structure, the conductive plane having an opening therein; and (b) disposing an antenna driving element adjacent the opening in the conductive plane on a side of said conductive plane which is remote from said array of conductive elements.

14. The method of claim 13 wherein the conductive plane and the array of conductive elements are disposed on opposite sides of an insulating substrate.

15. The method of claim 14 wherein the insulating substrate is of a type compatible with printed circuit manufacturing technology and wherein the array of conductive elements are formed thereon using printed circuit board manufacturing technology.

16. The method of claim 14 further including coupling each of the elements in the array to the conductive plane by a conductive via arranged through the insulating substrate.

17. The method of claim 16 wherein each conductive element in the array of conductive elements has a polygonal configuration and further including the step of arranging the conductive elements in the array are arranged in a regular repeating pattern of polygonal configurations.

18. The method of claim 17 wherein the polygonal configuration of each conductive element is a rectangle.

19. The method of claim 18 wherein the polygonal configuration of each conductive element is a square and wherein the square conductive elements are arranged with a common pitch in said array.

20. The method of claim 13 wherein the array of conductive elements is spaced from the conductive plane by a distance which is no greater than 10% of a wavelength of an operating frequency of the antenna structure.

21. A method of making an antenna comprising:

(a) providing a high impedance surface, the high impedance surface having a conductive plane and an array of conductive elements spaced from the conductive plane by a distance which is no greater than 25% of a wavelength of an operating frequency of the antenna structure the array of conductive elements being arranged with a common pitch in said array the conductive plane having an opening therein; and (b) disposing an antenna driving element adjacent the opening in the conductive plane;

wherein the opening formed in the conductive plane is rectangular, having a breadth which is about 0.5 of a wavelength of the operating frequency of the antenna structure and a width which is no greater than the common pitch of the conductive elements in the array.

22. The method of claim 21 wherein the width of the opening in the conductive plane is approximately equal to a spacing between adjacent ones of the conductive elements in said array.

23. The method of claim 21 wherein the antenna driving element is a waveguide.

24. The method of claim 23 wherein the waveguide has walls adjacent its aperture, which walls have a rectangular configuration adapted to mate with the opening in the conductive plane.

25. The method of claim 21 wherein the antenna driving element is a microstrip radiator disposed opposite and spaced from the opening in the conductive plane by a distance which is less than 10% of a wavelength of the operating frequency of the antenna structure.

26. An antenna structure comprising:

(a) a high impedance surface, the high impedance surface having a conductive plane and an array of conductive elements spaced from the conductive plane by a distance which is no greater than 25% of a wavelength of an operating frequency of the antenna structure, the conductive plane having a waveguide opening therein; and (b) a waveguide disposed adjacent the opening in the conductive plane, which waveguide, in operation, excites the antenna structure by pumping RF energy through the waveguide opening in the conductive plane.

27. The antenna structure of claim 26 wherein the conductive plane and the array of conductive elements are disposed on opposite side of a insulating substrate.

28. The antenna structure of claim 27 wherein each of the elements in the array is coupled to the conductive plane by a conductive via arranged through the insulating substrate.

29. The antenna structure of claim 28 wherein each conductive element in the array of conductive elements is of a polygonal configuration and wherein the conductive elements in the array are arranged in a regular repeating pattern of polygonal configurations.

30. The antenna structure of claim 29 wherein the polygonal configuration of each conductive element is a rectangle.

31. The antenna structure of claim 30 wherein the polygonal configuration of each conductive element is a square and wherein the square conductive elements are arranged with a common pitch in said array.

32. The antenna structure of claim 31 wherein the waveguide opening in the conductive plane is rectangular, having a breadth which is about 0.5 of a wavelength to one wavelength of the operating frequency of the antenna structure and a width which is no greater than the common pitch of the conductive elements in the array.

33. The antenna structure of claim 32 wherein the width of the waveguide opening in the conductive plane is approximately equal to a spacing between adjacent ones of the conductive elements in said array.

34. The antenna structure of claim 26 wherein the waveguide driving element has walls adjacent an aperture thereof, which walls have a rectangular configuration adapted to mate with the waveguide opening in the conductive plane.

35. The antenna structure of claim 26 wherein the array of conductive elements is spaced from the conductive plane by a distance which is no greater than 10% of a wavelength of an operating frequency of the antenna structure.

36. A method of making an antenna comprising:

(a) providing a high impedance surface, the high impedance surface having a conductive plane and an array of conductive elements spaced from the conductive plane by a distance which is no greater than 25% of a wavelength of an operating frequency of the antenna structure, the conductive plane having a waveguide opening therein; and (b) disposing a waveguide adjacent the waveguide opening in the conductive plane.

37. The method of claim 36 wherein the conductive plane and the array of conductive elements are disposed on opposite sides of an insulating substrate.

38. The method of claim 37 wherein the insulating substrate is of a type compatible with printed circuit manufacturing technology and wherein the array of conductive elements are formed thereon using printed circuit board manufacturing technology.

39. The method of claim 37 further including coupling each of the elements in the array to the conductive plane by a conductive via arranged through the insulating substrate.

40. The method of claim 39 wherein each conductive element in the array of conductive elements has a polygonal configuration and further including the step of arranging the conductive elements in the array are arranged in a regular repeating pattern of polygonal configurations.

41. The method of claim 40 wherein the polygonal configuration of each conductive element is a rectangle.

42. The method of claim 41 wherein the polygonal configuration of each conductive element is a square and wherein the square conductive elements are arranged with a common pitch in said array.

43. The method of claim 42 wherein the waveguide opening formed in the conductive plane is rectangular, having a breadth which is about 0.5 of a wavelength of the operating frequency of the antenna structure and a width which is no greater than the common pitch of the conductive elements in the array.

44. The method of claim 43 wherein the width of the waveguide opening in the conductive plane is approximately equal to a spacing between adjacent ones of the conductive elements in said array.

45. The method of claim 36 wherein the waveguide has walls adjacent its aperture, which walls have a rectangular configuration adapted to mate with the opening in the conductive plane.

46. The method of claim 36 wherein the array of conductive elements is spaced from the conductive plane by a distance which is no greater than 10% of a wavelength of an operating frequency of the antenna structure.

* * * * *